US008979311B2

(12) United States Patent
Kramer et al.

(10) Patent No.: US 8,979,311 B2
(45) Date of Patent: Mar. 17, 2015

(54) POWER SUPPLY SYSTEM FOR ADJUSTABLE SHELVING

(71) Applicant: Madix, Inc., Terrell, TX (US)

(72) Inventors: Steven Jay Kramer, Heath, TX (US); Michael R. Wade, West Brookfield, MA (US); Brandon Brooks, Ventura, CA (US)

(73) Assignee: Madix, Inc., Terrell, TX (US)

( * ) Notice: Subject to any disclaimer, the term of this patent is extended or adjusted under 35 U.S.C. 154(b) by 160 days.

(21) Appl. No.: 13/838,380

(22) Filed: Mar. 15, 2013

(65) Prior Publication Data

US 2013/0242561 A1 Sep. 19, 2013

Related U.S. Application Data

(60) Provisional application No. 61/612,776, filed on Mar. 19, 2012.

(51) Int. Cl.

| | |
|---|---|
| ***F21V 33/00*** | (2006.01) |
| ***F21V 21/002*** | (2006.01) |
| ***H01R 24/68*** | (2011.01) |
| ***H01R 25/14*** | (2006.01) |
| ***A47B 97/00*** | (2006.01) |
| *F21W 131/301* | (2006.01) |
| *F21W 131/405* | (2006.01) |
| *A47F 11/10* | (2006.01) |

(52) U.S. Cl.

CPC ..... *F21V 21/002* (2013.01); *H01R 24/68* (2013.01); *H01R 25/142* (2013.01); *A47B 97/00* (2013.01); *F21V 33/0012* (2013.01); *F21W 2131/301* (2013.01); *F21W 2131/405* (2013.01); *A47B 2220/0077* (2013.01); *A47F 11/10* (2013.01)

USPC ..... 362/253; 362/115

(58) Field of Classification Search

USPC ..... 362/253, 115

See application file for complete search history.

(56) References Cited

U.S. PATENT DOCUMENTS

| | | | | |
|---|---|---|---|---|
| 2004/0165330 | A1* | 8/2004 | Wolinsky et al. | 361/115 |
| 2007/0119795 | A1* | 5/2007 | Goldring et al. | 211/26 |

* cited by examiner

*Primary Examiner* — Joseph L Williams

(74) *Attorney, Agent, or Firm* — Hitchcock Evert LLP

(57) ABSTRACT

A system for lighting shelving with a conductive bus and shelf connectors aligned to allow engagement and disengagement of the shelf connectors during positioning and repositioning of shelves.

19 Claims, 6 Drawing Sheets

POWER SUPPLY SYSTEM FOR ADJUSTABLE SHELVING

CROSS-REFERENCE TO RELATED APPLICATION

This application claims the benefit of priority from U.S. Provisional Application No. 61/612,776 filed on Mar. 19, 2012.

FIELD OF THE INVENTION

This invention relates to lighting for shelving. More specifically, embodiments relate to power supply and power distribution systems for lighting in adjustable shelving.

BACKGROUND

Shelves used, for example, to display goods in retail stores sometimes include lamps arranged to provide light to enhance the appearance of goods displayed on the shelves. The lamps are conventionally powered from the store's electric power supply by jumper cables connecting to a wiring harness that in turn connects to the lamps by further jumper cables.

In many retail stores, shelving is repositioned frequently. When a shelf is moved, each lamp has to be disconnected from the jumper cable and the jumper cable disconnected from the harness before the shelf can be moved. Once in its new position, the harness must be repositioned and the jumper cables reconnected.

SUMMARY

An improved system for providing power to lights on retail shelves is disclosed. The system includes a vertically extending, elongate power bus mounted on a shelving system adjacent one edge of the shelves. For example, adjacent the rear edge of the shelf. The bus includes two parallel conductors extending vertically along the bus. The bus is provided with one or more electrical connectors for connecting the bus to a source of electric power, for example, at its top and bottom. The system further includes a shelf connector mounted on an edge of the shelf and comprising on one side an outwardly extending pair of connector pins adapted to make electric connection with the bus when the shelf is mounted on the shelf support at any vertical position along the length of the bus. On the other side of the shelf connector is an electrical output, such as a barrel connector, adapted to connect to a jumper cable that, in turn, is connected to lamps on the shelf. The barrel connector may, alternatively, be formed integrally with a jumper cable.

Embodiments of the present disclosure provide versatility in positioning and repositioning shelving with lighting features in an efficient manner. For example, some embodiments include a conductive bus that may be engaged and disengaged repetitively in multiple locations along the bus by an electrical connector with conductive prongs. The conductive bus may be located on an apparatus between shelf supports and oriented in combination with the electrical connector attached to a shelf such that when the shelf is attached to the supports, the electrical connector engages the conductive bus. In some embodiments, multiple shelves having separate electrical connectors may be attached to the supports and the electrical connectors of each shelf may be engaged with the conductive bus.

BRIEF SUMMARY OF THE DRAWINGS

Embodiments will now be described, by way of example only, with references to the accompanying drawings in which.

DETAILED DESCRIPTION

Figure 1:
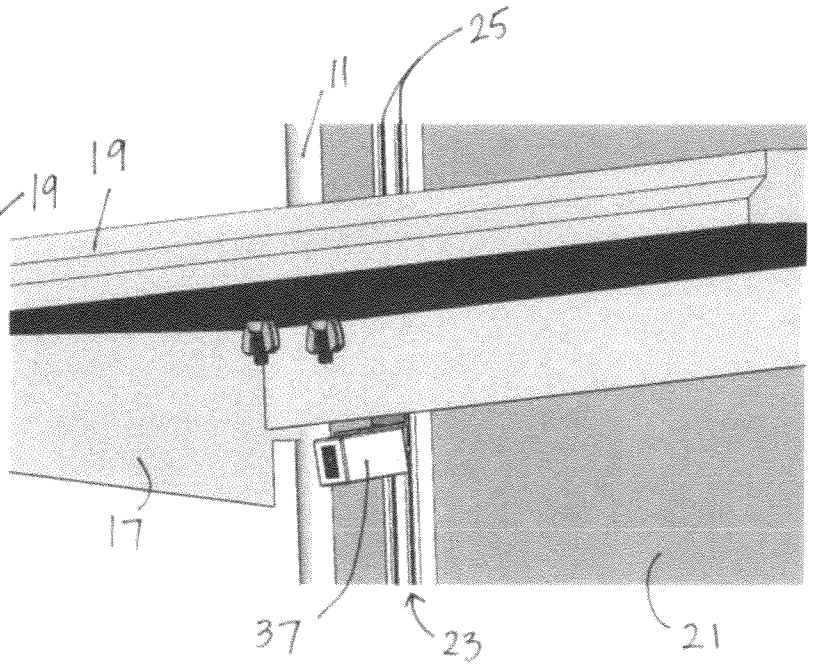
FIG. 1 is a partial view of a shelf showing the bus and shelf connector.
Figure 2:
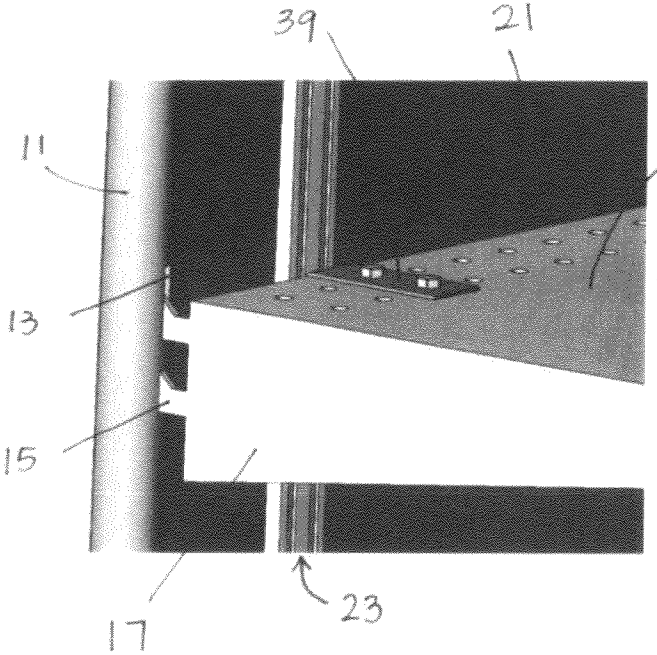
FIG. 2 shows the bus and the shelf of FIG. 1 mounted on a shelf support upright by a bracket and slot arrangement.

FIGS. 1 and 2 depict an embodiment of a shelving system that includes a plurality of spaced apart, vertical supports 11 (one of which is shown in FIGS. 1 and 2). The supports 11 include vertically spaced slots 13 for receiving hooks 15 of brackets 17 provided on a shelf 19 at its outer sides. The vertical position of the shelf 19 can be changed by engaging the hooks 15 in different slots 13. As will be appreciated, the design of the support and shelf brackets may vary and remain within the scope and spirit of the present disclosure. A back wall 21 of the system extends between adjacent supports 11.

Figure 3:
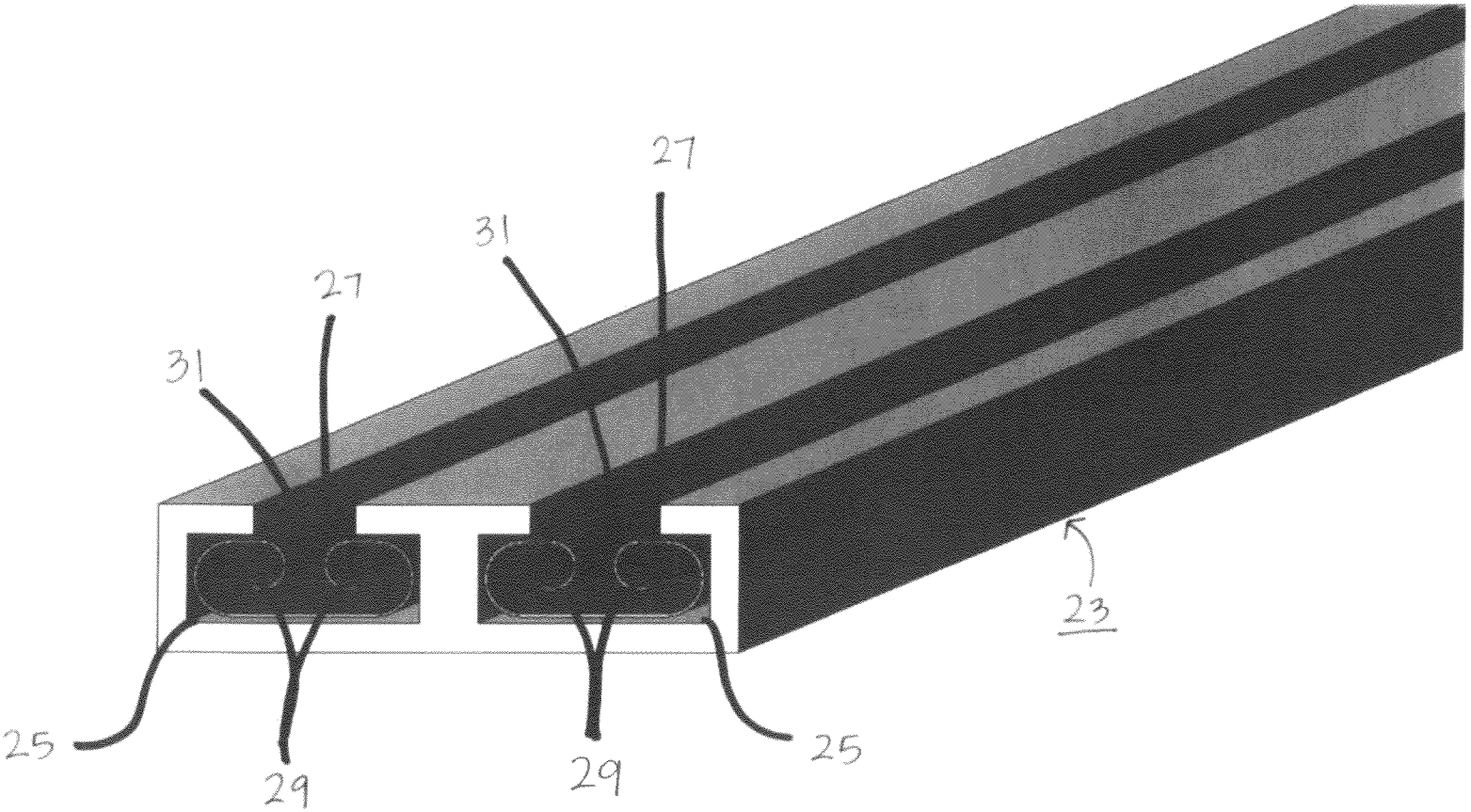
FIG. 3 is an enlarged view of an embodiment of the bus.

In this embodiment, a bus 23 is mounted on the wall 21 and extends vertically parallel to the supports 11. The bus 23, as seen in FIG. 3, comprises an extension with two longitudinally extending channels 25. The extension may be designed from insulating materials such as plastic or rubber. A conductor 27 is housed in each channel 25. In the embodiment shown in FIG. 3, each conductor 27 is a strip of conductive, resilient material, such as copper or aluminum, which in this embodiment is in the form of a U-shape, with open ends 29 curled inwardly to define an opening 31. The conductor 27 could, it will be appreciated, be of other shapes, such as flat. It will be appreciated that each conductor 27 maintains a different power line such that a connection across both conductors 27 creates an electrical circuit. In some embodiments, the conductor 27 may comprise a conductive wire affixed to one side of each channels 25, whereby a prong entering the channel 25 would create sufficient electrical connection with the conductor 27 for operation. It will be appreciated that a variety of conductor and bus designs may be used as the bus 23 and remain within the scope and spirit of the present disclosure.

In some embodiments, the bus 23 may be attached to existing components, such as a back wall 21 of an existing shelving system. The bus 23 may be attached to the wall 21 by any attachment means, such as adhesives, tapes (including double-sided tapes), screws, bolts, magnets, and/or other attachment mechanisms. In some embodiments, the bus 23 may be built into a component of the shelving system. For example, the bus may be built into the back wall 21 of the shelving system. In some embodiments, the bus 23 may be dual-sided such that connectors 37 may engage bus 23 from a front side of the shelving system or the back side of the shelving system. In such embodiments, the bus 23 may be centrally located between the supports 11, whereby the connector 37 will engage bus 23 whether the shelf is attached to the front or back side of the shelving system.

Figure 4:
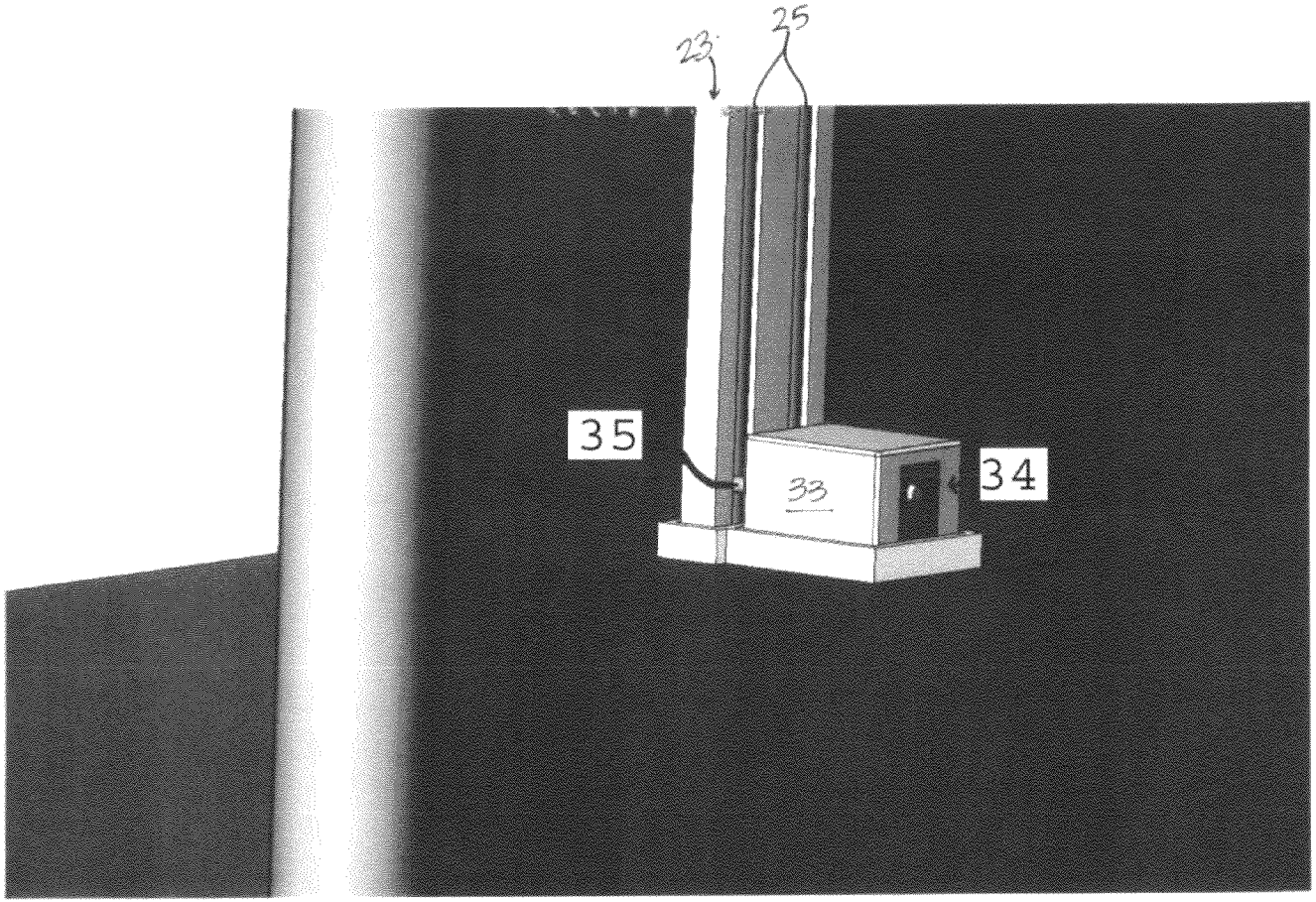
FIG. 4 shows an embodiment of a connector at the lower end of the bus.

As seen in FIG. 4, the bus 23 is provided with a connector 33. For example, connector 33 may be located on at least one end of the bus 23. In this embodiment, the connector 33 has on one side two prongs 35 adapted to make electrical contact with the conductors 27 of the bus 23. On the other side, the connector 33 has a barrel connector 34 which can be connected by a jumper cable to a power supply. In some embodiments, power for the bus 23 may be provided by direct connection between a power source and conductors 27.

Figures 5, 6:
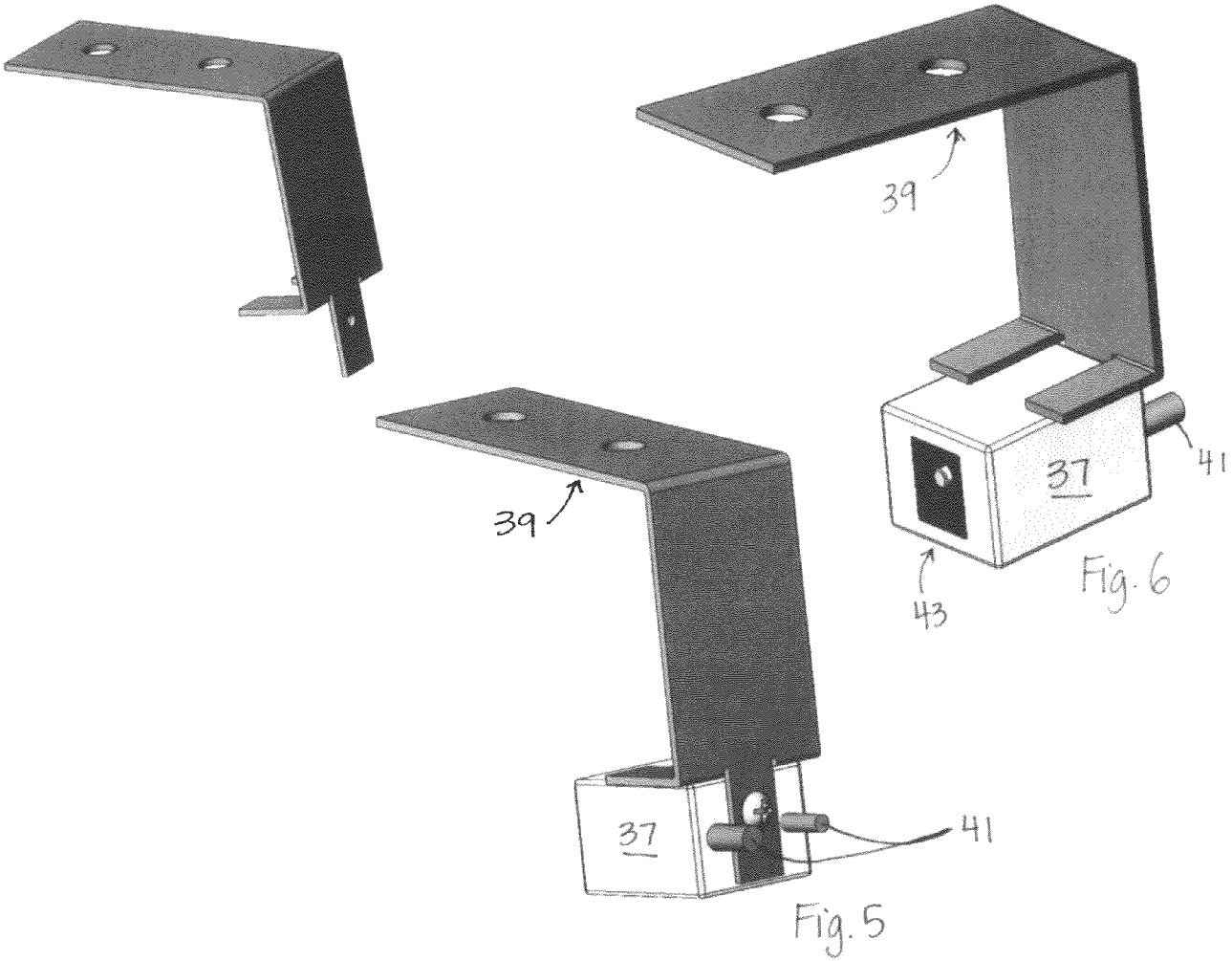
FIG. 5 is a view of one side of a shelf connector showing an embodiment of the bracket used to mount the connector on the edge of the shelf.
FIG. 6 is a view of the other side of the shelf connector and bracket.

FIGS. 5 and 6 show a shelf connector 37 and associated mounting bracket 39 by which the connector 37 is mounted on the rear edge of the shelf 19 in register with the bus 23. It will be appreciated that in some embodiments the mounting bracket 39 may not be required. For example, in some embodiments the shelf connector 37 may be integrated into the design of shelf 19. The connector 37 comprises two rearwardly extending conductive prongs 41 adapted to make electrical contact with the conductors 27 of the bus 23. On its other side, the connector 37 has a barrel connector 43 adapted to connect to a jumper cable (not shown) that, in turn, is connected to lamps or other lighting devices (not shown) mounted on the shelf 19. In an alternative embodiment, the jumper cable is integral with the barrel connector. It will be appreciated that the electric supply system disclosed with regard to lighting herein may be used to supply power to additional or alternative devices, such as displays, fans, security equipment, and sensors.

As will be appreciated, from FIG. 3, the open ends 29 of the conductors 27 provide a resilient receptacle for the conductive prongs 41 and allow electrical connection between the shelf connector 37 and the bus 23 regardless of the vertical positioning of the shelf 19. In some embodiments, conductive prongs 41 may be associated with a spring to allow resiliency to engage conductors 27 of bus 23. Such resiliency allows versatility in spacing between the rear of shelf 19 and bus 23 on different shelving systems. For example, a spring may compress when the distance between the bus 23 and the shelf 19 is small, but provide sufficient extension and support to create an electrical connection between the bus 23 and conductive prongs 41 when the distance is larger.

The arrangement considerably simplifies the repositioning of the shelf 19. Removal of the shelf 19 automatically disconnects the shelf connector 37 from the bus 23. When the shelf 19 is reconnected to the supports 11, the connector 37 is automatically inserted into the opening 31 of the conductors 27 re-establishing electrical connection.

Figure 7:
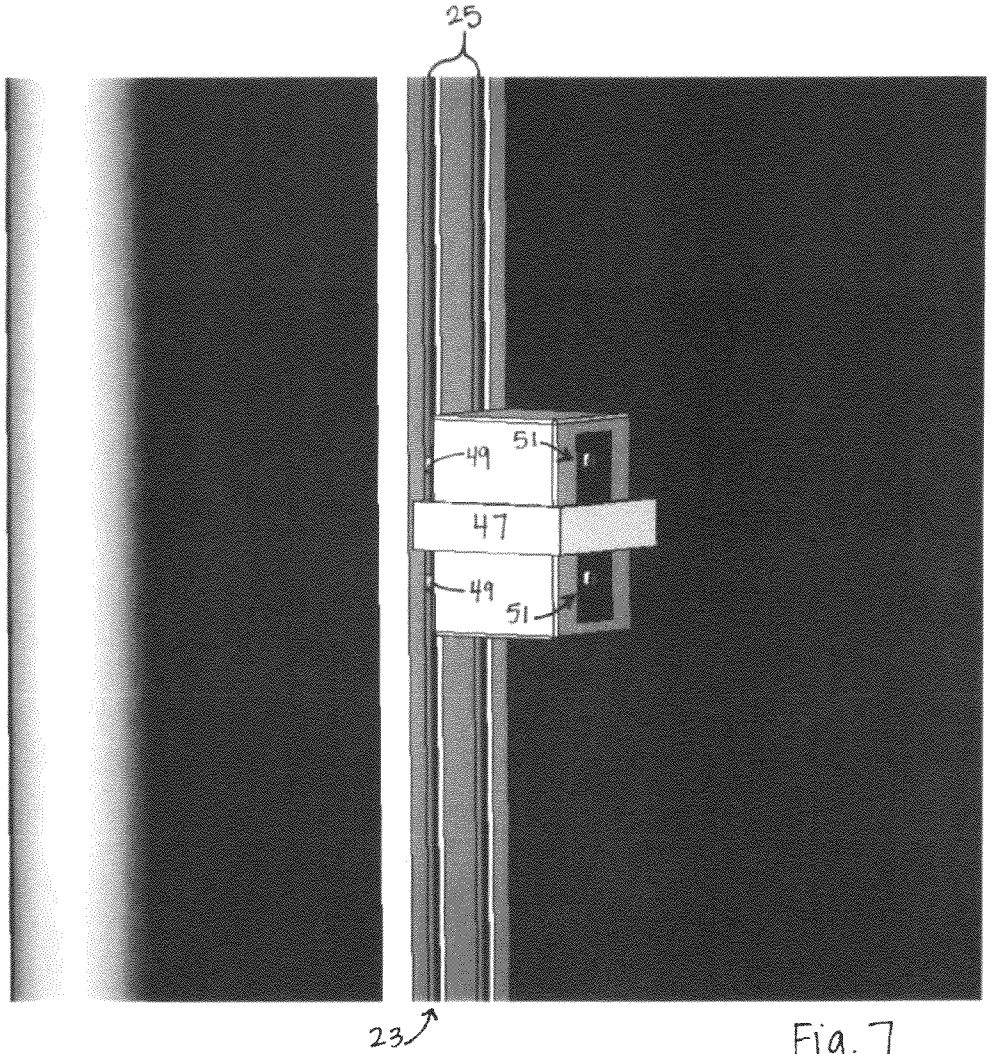
FIG. 7 shows an embodiment of a dual connector attached to an embodiment of the bus.

FIG. 7 depicts a dual connector 47 having two vertically aligned sets of conductive prongs 49 and a pair of vertically aligned barrel connectors 51. The conductive prongs 49 are shown engaged with the channels 25 of the bus 23. The dual connector 47 may be used to provide a power supply to lights or other apparatus associated with the shelving system. The dual connector 47 may be used in conjunction with or as an alternative to shelf connector 37. For example, a shelf 19 having a shelf connector 37 may be connected above the dual connector 47, whereby shelf connector 37 is used to power a Light Emitting Diode (LED) strip on the shelf 19, while one barrel connection 51 is used to power a spotlight for a featured item, and the second barrel connection 51 is used to power a video display. In some embodiments, one barrel connector 51 may be used to provide power from a power source to the bus 23 while the second barrel connector 51 is used to provide power from the bus 23 to another system.

It will be appreciated that the design and lighting fixtures powered by the system may vary and remain within the scope and spirit of the disclosure. For some embodiments, lighting for the shelves may be integrated into the shelves. For example, an LED strip may be built under the front edge of shelf 19 such that the area underneath shelf 19 would be illuminated. For another example, shelf 19 may include a transparent or semi-transparent top with built in LEDs to illuminate the top of shelf 19.

Pre-existing lighting fixtures may be wired to shelf connectors using jumpers with complementary connections to barrel connector 43. It will be appreciated that in some embodiments the shelf lighting may be integrated into the shelf 19 and wired directly to an integrated shelf connector 37 without using a barrel connector 43.

It will be appreciated that the type of connectors used may be varied in many ways and remain within the scope and spirit of the invention. For example, complementary male and female connectors depicted in the examples herein may be inverted between complementary pieces, such as the bus 23 having conductive rails extending outward and shelf connectors 37 having cavities to accept the conductive rails and establish an electrical connection. For another example, the barrel connector 43 may be replaced with a dual pronged plug.

Figure 8:
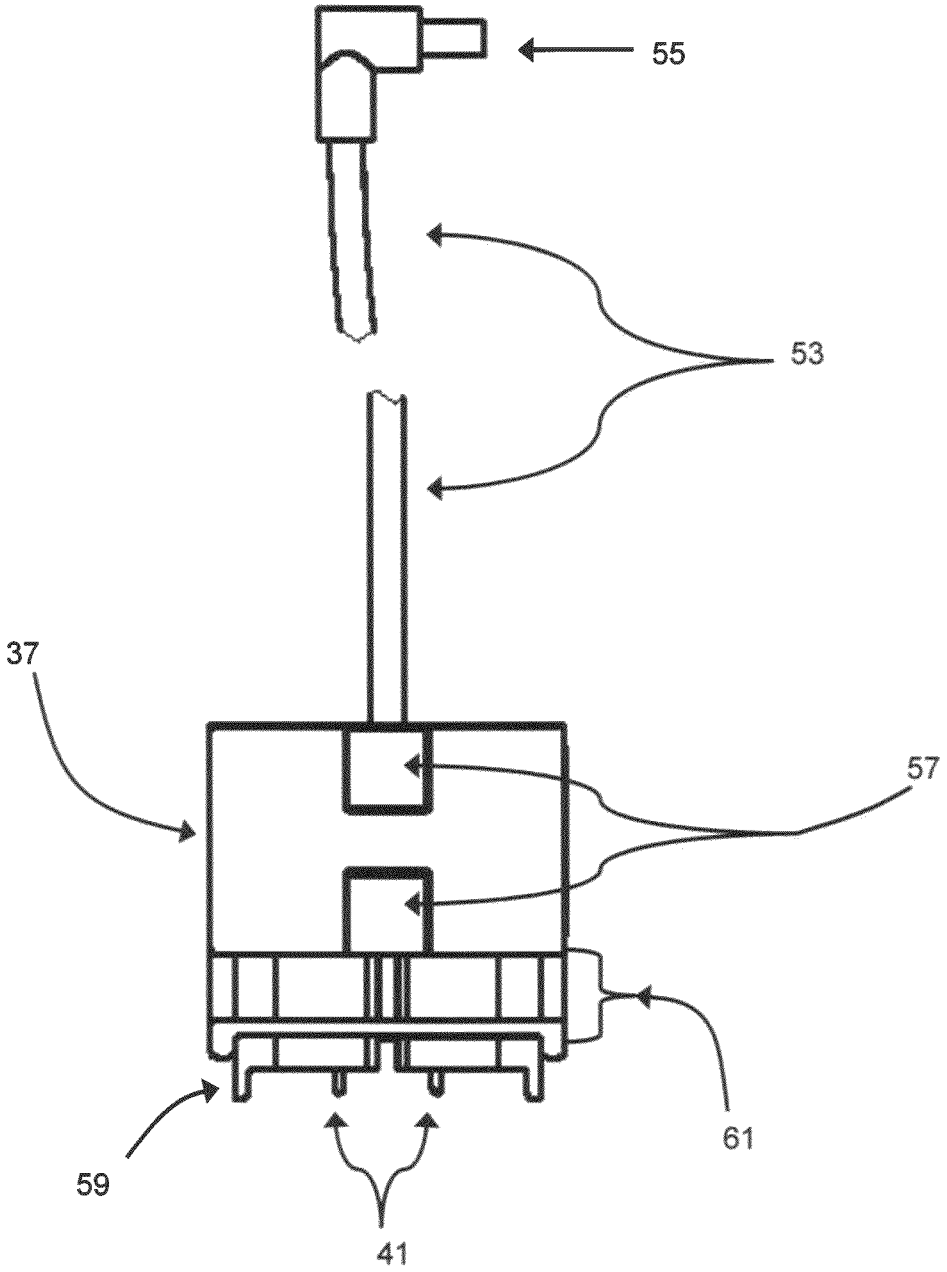
FIG. 8 is a top view of another embodiment of the shelf connector.

FIG. 8 shows another embodiment of a shelf connector 37 which includes a shelf reception area 61 defined by a vertical frame 59 proximate to conductive prongs 41 and the additional body of shelf connector 37 connected to jumper cable 53. In some embodiments, the vertical frame 59 may include a lip directed towards the additional body of shelf connector 37 which may in some circumstances engage or otherwise improve the connection between the shelf connector 37 and shelf 19. The shelf connector 37 may be placed on the rear edge of the shelf 19 in register with the bus 23, wherein the shelf reception area 61 may receive a downward lip or other portion of shelf 19. In this embodiment, the shelf connector 37 includes magnets 57 to attach the shelf connector to the shelf 19. In some embodiments, the body of the shelf connector 37 in conjunction with the vertical frame 59 may create a pressure connection or other interlocking connection with shelf 19 when a portion of shelf 19 is within the shelf reception area 61. The connector 37 also comprises two rearwardly extending conductive prongs 41 adapted to make electrical contact with the conductors 27 of the bus 23. In some embodiments, the conductive prongs 41 may be resiliently compressible. For example, conductive prongs 41 may be associated with a spring to allow resiliency to engage conductors 27 of bus 23. On its other side, the connector 37 has a jumper cable 53 having an electrical connector 55 which may be connected to lamps or other lighting devices (not shown) mounted on the shelf 19. It will be appreciated that the electric supply system disclosed with regard to lighting herein may be used to supply power to additional or alternative devices, such as displays, fans, security equipment, and sensors.

The invention being thus described, it will be obvious that the same may be varied in many ways. Such variations are not to be regarded as a departure from the spirit and scope of the invention and all such modifications as would be obvious to one skilled in the art are intended to be included within the scope of the system or method described.

The invention claimed is:

1. A power supply system for adjustable shelving comprising a vertically extended bus associated with a support system for a shelf, wherein said bus comprises two elongate conductors; and a shelf connector associated with said shelf and oriented such that said shelf connector engages said conductors to create a conductive connection when said shelf is attached to said support system, and said shelf connector disengages said conductors when said shelf is detached from said support system.

2. A system according to claim 1, wherein said shelf connector comprises a first side having a bus engagement connector and a second side having an electric power output.

3. A system according to claim 2, wherein said second side of said shelf connector comprises a plurality of electric power outputs.

4. A system according to claim 1, wherein said bus comprises two channels each containing one of said conductors; said shelf connector comprises a set of conductive prongs spaced to correspond to said two channels of said bus, whereby when said shelf is attached, said conductive prongs create a conductive connection with said conductors.

5. A system according to claim 3, wherein the conductors are in the form of conductive strips.

6. A system according to claim 3, wherein the conductors are flat.

7. A system according to claim 5, wherein each said conductive strip comprise a U-shape with its open ends curled inwardly to define an opening.

8. A system according to claim 1, comprising a lighting fixture operatively associated with said shelf connector.

9. A system according to claim 1, comprising a bus power connector, wherein said bus power connector provides a supply of power to said bus.

10. A system according to claim 9, wherein said bus power connector engages said conductors to create a conductive connection with said bus.

11. A system according to claim 1, wherein said shelf connector comprises a set of conductive prongs designed to connect to said bus, whereby when said shelf is attached, said conductive prongs create a conductive connection with said conductors.

12. A system according to claim 11, wherein said conductive prongs are resiliently compressible.

13. A system according to claim 1, wherein said bus is attached to said support system by at least one of adhesives, tapes, screws, bolts, and magnets.

14. A system according to claim 1, wherein said shelf connector is attached to said shelf by at least one of adhesives, tapes, screws, bolts, and magnets.

15. A system according to claim 1, wherein said shelf connector is designed to receive a portion of said shelf.

16. A system according to claim 15, wherein said shelf connector is designed to interlock with said portion of said shelf.

17. A system according to claim 1, wherein said bus comprises a front side and a back side whereby each of said front side and said back side of said bus are operatively engageable by said shelf connector.

18. A power supply system for adjustable shelving comprising a support system for a shelf comprising a vertically extended bus, wherein said bus comprises two elongate conductors and wherein said bus is operatively connectable to a power supply; and said shelf comprising a shelf connector oriented such that said shelf connector engages said conductors to create a conductive connection when said shelf is attached to said support system, and said shelf connector disengages said conductors when said shelf is detached from said support system.

19. A system according to claim 18, wherein operatively associated with said shelf connector is at least one of a lighting fixture, a display, a fan, security equipment, and sensors.

* * * * *